US008870338B2

(12) United States Patent
Kyoso et al.

(10) Patent No.: US 8,870,338 B2
(45) Date of Patent: Oct. 28, 2014

(54) METHOD FOR ADJUSTING HEAD MODULE, METHOD FOR MANUFACTURING INKJET HEAD, AND INKJET HEAD

(71) Applicant: FUJIFILM Corporation, Tokyo (JP)

(72) Inventors: Tadashi Kyoso, Kanagawa (JP); Hiroyuki Shibata, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 14/141,299

(22) Filed: Dec. 26, 2013

(65) Prior Publication Data

US 2014/0184696 A1 Jul. 3, 2014

(30) Foreign Application Priority Data

Dec. 27, 2012 (JP) ..... 2012-285130

(51) Int. Cl.
*B41J 29/393* (2006.01)
*B41J 2/14* (2006.01)

(52) U.S. Cl.
CPC ..... *B41J 2/14* (2013.01)
USPC ..... 347/19

(58) Field of Classification Search
USPC ..... 347/14, 19
See application file for complete search history.

(56) References Cited

U.S. PATENT DOCUMENTS

| | | | | |
|---|---|---|---|---|
| 7,377,610 | B2 * | 5/2008 | Hirakawa | 347/15 |
| 7,731,332 | B2 * | 6/2010 | Hori | 347/43 |
| 8,454,109 | B2 * | 6/2013 | Shibata | 347/9 |
| 2006/0279606 | A1 | 12/2006 | Jahana et al. | |
| 2011/0234673 | A1 | 9/2011 | Ueshima | |
| 2012/0212534 | A1 | 8/2012 | Tanase et al. | |

FOREIGN PATENT DOCUMENTS

| | | | |
|---|---|---|---|
| JP | 2006-341518 | A | 12/2006 |
| JP | 2009-023292 | A | 2/2009 |
| JP | 2011-056880 | A | 3/2011 |
| JP | 2011-073185 | A | 4/2011 |

OTHER PUBLICATIONS

The extended European search report issued by the European Patent Office on Mar. 21, 2014, which corresponds to EP13196629.3-1701 and is related to U.S. Appl. No. 14/141,299.

* cited by examiner

*Primary Examiner* — Lamson Nguyen
(74) *Attorney, Agent, or Firm* — Studebaker & Brackett PC

(57) ABSTRACT

A method for adjusting a head module of an inkjet head in which a plurality of head modules having nozzles capable of ejecting droplets are connected and linked together is disclosed. The inkjet head has an overlapping region in which an arrangement sequence of the head modules corresponding to the ejected droplets is alternate between adjacent head modules. The method includes the steps of: obtaining, among intervals between the droplet ejected by one of the head modules and the droplet ejected by another one of the head modules in the overlapping region, a largest interval between the droplets in a direction of alignment of the head modules based upon movement of the droplets caused by a landing interference; and adjusting the adjacent head modules in a direction to decrease the largest interval between the droplets.

20 Claims, 19 Drawing Sheets

FIG. 9

| PIXEL NUMBER | MODULE | LANDING SEQUENCE |
|---|---|---|
| 1 | B | 2 |
| 2 | B | 1 |
| 3 | A | 3 |
| 4 | A | 4 |
| 5 | B | 2 |
| 6 | B | 1 |
| 7 | A | 3 |
| 8 | A | 4 |
| 9 | B | 2 |
| 10 | B | 1 |
| ... | ... | ... |
| 96 | A | 4 |

FIG. 13

| Δx[μm] | -12 | -11 | -10 | -9 | -8 | -7 | -6 | -5 | -4 | -3 | -2 | -1 | 0 |
|---|---|---|---|---|---|---|---|---|---|---|---|---|---|
| IMAGE QUALITY | B | A | A | A | A | A | A | A | A | A | A | A | A |

| Δx[μm] | 1 | 2 | 3 | 4 | 5 | 6 | 7 | 8 | 9 | 10 | 11 | 12 | 13 |
|---|---|---|---|---|---|---|---|---|---|---|---|---|---|
| IMAGE QUALITY | A | A | A | A | A | B | B | B | B | B | B | B | B |

| PIXEL NUMBER | MODULE | LANDING SEQUENCE |
|---|---|---|
| 1 | B | 1 |
| 2 | B | 2 |
| 3 | A | 4 |
| 4 | A | 3 |
| 5 | B | 1 |
| 6 | B | 2 |
| 7 | A | 4 |
| 8 | A | 3 |
| 9 | B | 1 |
| 10 | B | 2 |
| ... | ... | ... |
| 96 | A | 3 |

FIG. 17

| Δx[μm] | -12 | -11 | -10 | -9 | -8 | -7 | -6 | -5 | -4 | -3 | -2 | -1 | 0 |
|---|---|---|---|---|---|---|---|---|---|---|---|---|---|
| IMAGE QUALITY | B | B | B | B | B | B | B | A | A | A | A | A | A |

| Δx[μm] | 1 | 2 | 3 | 4 | 5 | 6 | 7 | 8 | 9 | 10 | 11 | 12 | 13 |
|---|---|---|---|---|---|---|---|---|---|---|---|---|---|
| IMAGE QUALITY | A | A | A | A | A | A | A | A | A | A | A | B | B |

| PIXEL NUMBER | MODULE | LANDING SEQUENCE |
|---|---|---|
| 1 | B | 1 |
| 2 | B | 2 |
| 3 | A | 3 |
| 4 | A | 4 |
| 5 | B | 1 |
| 6 | B | 2 |
| 7 | A | 3 |
| 8 | A | 4 |
| 9 | B | 1 |
| 10 | B | 2 |
| ... | ... | ... |
| 96 | A | 4 |

FIG. 20

| Δx[μm] | −12 | −11 | −10 | −9 | −8 | −7 | −6 | −5 | −4 | −3 | −2 | −1 | 0 |
|---|---|---|---|---|---|---|---|---|---|---|---|---|---|
| IMAGE QUALITY | B | B | A | A | A | A | A | A | A | A | A | A | A |

| Δx[μm] | 1 | 2 | 3 | 4 | 5 | 6 | 7 | 8 | 9 | 10 | 11 | 12 | 13 |
|---|---|---|---|---|---|---|---|---|---|---|---|---|---|
| IMAGE QUALITY | A | A | A | A | A | A | B | B | B | B | B | B | B |

METHOD FOR ADJUSTING HEAD MODULE, METHOD FOR MANUFACTURING INKJET HEAD, AND INKJET HEAD

BACKGROUND OF THE INVENTION

1. Field of the Invention

The present invention relates to a method for adjusting a head module, a method for manufacturing an inkjet head, and an inkjet head, and in particular, to a method for adjusting a head module, a method for manufacturing an inkjet head, and an inkjet head in view of the landing interference of ejected droplets.

2. Description of the Related Art

In the field of inkjet image formation, in order to realize high imaging resolution and high productivity, a head module in which multiple nozzles are arranged in a two-dimensional manner is formed, and a plurality of head modules are arranged in a width direction of a recording medium, thereby constituting an elongated head (full line-type head) which covers an image formation region of the overall width of the recording medium. The inkjet imaging system (single pass system) is known, in which the recording medium is relatively scanned in a direction perpendicular to a width direction of the elongated head only once to form an image on the recording medium.

When a plurality of head modules are arranged to form an inkjet head as described above, if the head modules are not linked with each other precisely, overall head modules are moved (shifted) in a direction of either one of adjacent head modules, causing a problem that nozzle intervals differ in the link portion of the head modules, and quality of an image to be formed is degraded. If the head modules can be arranged with high precision, it is possible to maintain favorable image quality in the link portion. However, it is technically difficult to arrange the head modules with high precision, and cost (apparatus cost and the number of operations) is required for the arrangement with high precision.

In order to arrange the head modules with high precision, for example, JP2011-56880A describes that, in a line printer in which a plurality of heads are arranged, a test pattern is created and the amount of adjustment of a nozzle position of a head is calculated from the test pattern to adjust the position of the head. JP2009-23292A describes that, in a line head in which a plurality of heads are arranged, an image for position adjustment is printed and the nozzle position is determined and confirmed visually to move the head. JP2006-341518A describes that the relative position of a nozzle is set by the amount of deflection of ink, thereby forming a high-quality image.

SUMMARY OF THE INVENTION

In the inkjet image formation, so-called landing interference occurs. which is a phenomenon that an interaction between the dots that are continuously landed on a recording medium and come into contact with each other causes the dots to relatively move, that is, the dot which subsequently landed moves. Accordingly, when precision in the link portion of the head modules is deteriorated, and dots move in a direction away from each other due to the landing interference, there is a problem that the white space between the dots is recognized visually. In the inkjet recording apparatus described in JP2011-56880A, JP2009-23292A, and JP2006-341518A, the adjustment of the head is not performed in view of the landing interference.

The invention has been accomplished in consideration of the above-described situation, and an object of the invention is to provide a method for adjusting a head module in view of the landing interference, a method for manufacturing an inkjet head, and an inkjet head having an advantage of obtaining favorable image quality.

In order to attain the above-described object, according to an aspect of the present invention, there is provided a method for adjusting a head module of an inkjet head in which a plurality of head modules having a plurality of nozzles capable of ejecting droplets are connected and linked together, the inkjet head having an overlapping region in which an arrangement sequence of the head modules corresponding to the ejected droplets becomes alternate between adjacent head modules. The method includes the steps of: obtaining, among intervals between the droplet ejected by one of the head modules and the droplet ejected by another one of the head modules in the overlapping region, a largest interval between the droplets in a direction of alignment of the head modules based upon movement of the droplets caused by a landing interference, which is an interaction between the droplets ejected from the nozzles of the head modules, the droplets being attracted to each other due to the interaction; and adjusting the adjacent head modules in a direction to decrease the largest interval between the droplets.

According to the above aspect of the invention, the droplets having the largest interval between the droplets due to the movement of the droplets caused by the landing interference in the overlapping regions of the head modules is obtained. The head modules are connected together with the head modules being moved in a direction of decreasing the largest interval between the droplets when linking the head modules together. If the head modules are linked together with high precision, it is possible to obtain favorable image quality in the overlapping regions. However, it is difficult to link the head modules together with high precision, and if the movement of the droplets due to landing interference occurs in the same direction in addition to landing deviation by linking of the head modules, there is concern about degradation of image quality. According to the aspect of the invention, when linking the head modules, the positions of the head module are adjusted in view of the landing interference in a direction to decrease the interval between the droplets (i.e., a direction to cancel the landing interference) against a direction to increase the interval between the droplets due to the landing interference. Therefore, since it is possible to link the head modules within a range of favorable image quality even if an error occurs in positioning the head modules, it is possible to form a favorable image and to prevent degradation of image quality.

In the method for adjusting a head module, the largest interval between the droplets may be determined according to a landing sequence of the droplets.

According to the method for adjusting a head module, since the droplets to be moved due to the landing interference are predicted according to the landing sequence, thereby the droplets between which the interval is largest is determined.

In the method for adjusting a head module, an image quality allowable range may be obtained by ejecting the droplets while changing the interval between the adjacent head modules, and the head modules are adjusted with a center value of the image quality allowable range as a target.

According to the method for adjusting a head module, the droplets are ejected while actually changing the interval between the head modules, thereby the image quality allowable range is determined. The head modules are linked together with the center value of the allowable range as a target. Therefore, even if the link position of the head module is deviated, it is possible to allow the image quality to fall within the image quality allowable range, and to form an image having favorable image quality.

In the method for adjusting a head module, an image quality allowable range may be obtained by a simulation by using at least one of a type of recording medium, a type of droplet, and a presence/absence of processing liquid application to the recording medium as a parameter, and the head modules are adjusted with a center value of the image quality allowable range as a target.

According to the method for adjusting a head module, a simulation is performed to determine the image quality allowable range, and the head modules are linked together with the center value of the allowable range as a target. Accordingly, even if the link position of the head module is deviated, it is possible to allow the image quality to fall within the image quality allowable range, and to obtain favorable image quality.

In the method for adjusting a head module, due to the landing interference, a first droplet, which is first ejected, and a second droplet, which is ejected adjacent to the first droplet, may be moved in a manner so that a movement distance of the second droplet is greater than a movement distance of the first droplet.

According to the method for adjusting a head module, since the first droplet, which is initially ejected, and the second droplet, which is ejected adjacent to the first droplet, are moved in a manner so that the displacement of the second droplet is greater, it is possible to predict the displacement of the ejected droplets according to the landing sequence, and to determine a direction in which the head modules are to be adjusted.

In the method for adjusting a head module, when a link positioning precision of the head modules is $\Delta x$, $\Delta x>0$ is a direction of increasing a distance between adjacent head modules, and $\Delta x<0$ is a direction of decreasing the distance between adjacent head modules, when the alignment of the head modules is the same as the alignment of the head modules corresponding to the droplets having the largest interval due to landing interference, the head modules are adjusted in a direction of $\Delta x<0$, and when the alignment of the head modules is opposite to the alignment of the head modules corresponding to the droplets having the largest interval due to landing interference, the head modules are adjusted in a direction of $\Delta x>0$.

According to the method for adjusting a head module, when the alignment of the head modules is the same as the alignment of the head modules corresponding to the droplets having the largest interval due to the landing interference in the overlapping regions of the head modules, the head modules are adjusted in the direction of $\Delta x<0$, that is, in the direction of decreasing the distance between the head modules, thereby suppressing the influence due to the landing interference. When the alignment of the head modules is opposite to the alignment of the head modules corresponding to the largest interval due to the landing interference, the head modules are adjusted, in the direction of $\Delta x>0$, that is, in the direction of increasing the distance between the head modules, thereby suppressing the influence due to the landing interference. Therefore, it is possible to obtain favorable image quality even in the overlapping regions of the head modules.

In the method for adjusting a head module, head modules corresponding to a plurality of kinds of ink including a black ink may be provided, and the head modules corresponding to ink of other colors than the black ink may be adjusted with a center value of the image quality allowable range determined using the black ink as a target.

Since the interval between the droplets is most recognizable visually when the black ink is used, the condition of the method for adjusting a head module is determined using the black ink, and the head modules of ink of other colors are adjusted under this condition determined using the black ink, thereby obtaining favorable image quality.

In order to attain the above-described object, according to another aspect of the present invention, there is provided a method for manufacturing an inkjet head, including adjusting a head module using the above-described method for adjusting the head module.

According to the method for manufacturing an inkjet head, it is possible to manufacture an inkjet head capable of forming a favorable image.

In order to attain the above-described object, according to still another aspect of the present invention, there is provided an inkjet head which is adjusted by the above-described method for adjusting a head module.

According to the inkjet head, it is possible to form a favorable image.

According to the method for adjusting a head module, the method for manufacturing an inkjet head, and the inkjet head of the aspects of the present invention, since the head modules are adjusted taking the landing interference into consideration, it is possible to allow the image quality to fall within the allowable range even if a certain level of error occurs in positioning the head modules, thereby obtaining favorable image quality.

BRIEF DESCRIPTION OF THE DRAWINGS

FIG. 9 is a table showing a pixel number counted from a head module A side to a head module B side, the type of head module, and a landing sequence according to a first embodiment.

FIG. 13 shows an experimental result showing an image quality allowable range in the nozzle arrangement of the first embodiment.

FIG. 17 shows an experimental result showing an image quality allowable range in the nozzle arrangement of the second embodiment.

FIG. 20 shows an experimental result showing an image quality allowable range in the nozzle arrangement of the third embodiment.

DESCRIPTION OF THE PREFERRED EMBODIMENTS

Hereinafter, a preferred embodiment of the invention will be described referring to the accompanying drawings.

First, the exemplary embodiments of a head module, an inkjet head having a plurality of head modules, and an inkjet recording apparatus having the inkjet head will be described.

[Overall Configuration of Inkjet Recording Apparatus]

Figure 1:
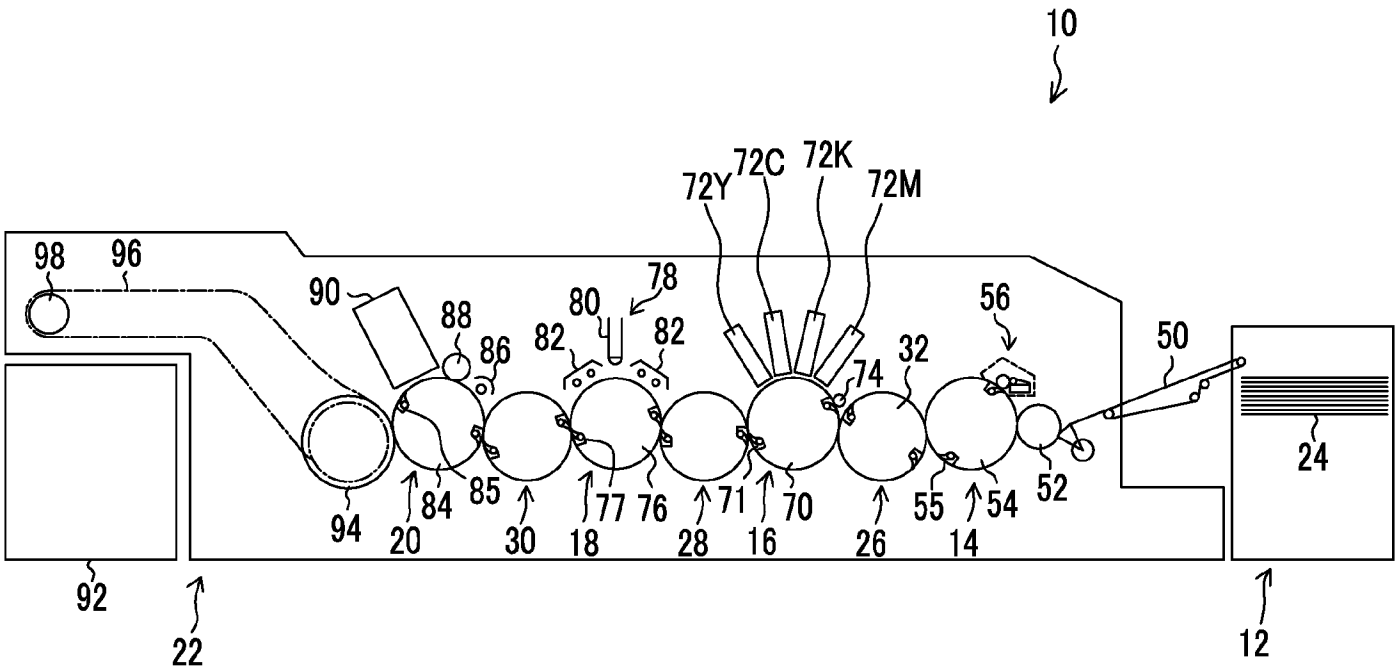
FIG. 1 is an overall configuration diagram of an inkjet recording apparatus.

First, the overall configuration of the inkjet recording apparatus will be described. FIG. 1 is a configuration diagram showing the overall configuration of the inkjet recording apparatus.

The inkjet recording apparatus 10 is an impression cylinder direct-imaging inkjet recording apparatus which ejects ink of a plurality of colors onto a recording medium 24 (for convenience, referred to as "sheet") held in an impression cylinder (image formation drum 70) of the image formation unit 16 from inkjet heads 72M, 72K, 72C, and 72Y to form a desired color image. The inkjet recording apparatus 10 is also an on-demand image forming apparatus, to which a two-liquid reaction (aggregation) system is applied, which applies a processing liquid (in this case, a aggregation processing liquid) onto the recording medium 24 before ink ejection and causes the processing liquid to react with ink liquid to perform image formation on the recording medium 24.

As shown in the drawing, the inkjet recording apparatus 10 includes a sheet feed unit 12, a processing liquid application unit 14, an image formation unit 16, a drying unit 18, a fixing unit 20, and a discharge unit 22.

(Sheet Feed Unit)

The sheet feed unit 12 is a mechanism which feeds the recording medium 24 to the processing liquid application unit 14, and in the sheet feed unit 12, recording mediums 24 as sheets of paper are stacked. The sheet feed unit 12 is provided with a sheet feed tray 50, and the recording mediums 24 are fed from the sheet feed tray 50 to the processing liquid application unit 14 one by one.

In the inkjet recording apparatus 10 of this example, as the recording medium 24, various recording media 24 of different sheet types or sizes (sheet size) may be used. The sheet feed unit 12 may be configured to include a plurality of sheet trays (not shown) in which various types of recording media are separately stacked, and sheet to be fed from the plurality of sheet trays to the sheet feed tray 50 may be automatically switched. Otherwise, an operator may select or replace a sheet tray as necessary. In this example, although a sheet of paper (cut paper) is used as the recording medium 24, another configuration may be applied, for example, in which a continuous sheet (roll paper) is cut in necessary size and fed.

(Processing Liquid Application Unit)

The processing liquid application unit 14 is a mechanism which applies a processing liquid to the recording surface of the recording medium 24. The processing liquid includes a color material aggregating agent which aggregates a color material (in this example, a pigment) in ink to be applied by the image formation unit 16, and the processing liquid comes into contact with ink, such that separation of the color material and a solvent in ink is accelerated.

As shown in FIG. 1, the processing liquid application unit 14 includes a sheet feed cylinder 52, a processing liquid drum 54, and a processing liquid coating device 56. The processing liquid drum 54 is a drum which rotates while holding the recording medium 24, thereby conveying the recording medium. The processing liquid drum 54 includes a claw-shaped holding unit (gripper) 55 on the outer circumferential surface thereof, and the recording medium 24 is sandwiched between the claw of the holding unit 55 and the circumferential surface of the processing liquid drum 54 to hold the leading end of the recording medium 24. The processing liquid drum 54 may be provided with an absorption hole on the outer circumferential surface thereof, and a suction unit which performs suction from the absorption hole may be connected thereto. Accordingly, the recording medium 24 can be in close contact with and held on the circumferential surface of the processing liquid drum 54.

Outside the processing liquid drum 54, the processing liquid coating device 56 is provided to face the circumferential surface of the processing liquid drum 54. The processing liquid coating device 56 has a processing liquid container in which the processing liquid is stored, an onyx roller which is partially dipped in the processing liquid of the processing liquid container, and a rubber roller which is pressed against the recording medium 24 on the processing liquid drum 54 to transfer the processing liquid after measuring to the recording medium 24. According to the processing liquid coating device 56, the processing liquid can be coated on the recording medium 24 while being measured.

The recording medium 24 with the processing liquid applied by the processing liquid application unit 14 is delivered from the processing liquid drum 54 to the image formation drum 70 of the image formation unit 16 through an intermediate conveying unit 26.

(Image Formation Unit)

The image formation unit 16 includes an image formation drum (a second conveying body) 70, a sheet suppression roller 74, and inkjet heads 72M, 72K, 72C, and 72Y Similarly to the processing liquid drum 54, the image formation drum 70 includes a claw-shaped holding unit (gripper) 71 on the outer circumferential surface thereof. The recording medium 24 fixed on the image formation drum 70 is conveyed such that the recording surface turns outward, and ink is applied from the inkjet heads 72M, 72K, 72C, and 72Y to the recording surface.

Each of the inkjet heads 72M, 72K, 72C, and 72Y may be a full-line inkjet recording head (inkjet head) which has a length corresponding to the maximum width of an image forming region in the recording medium 24. A nozzle column with a plurality of ink ejecting nozzles arranged over the overall width of the image forming region is formed on an ink ejection surface. Each of the inkjet heads 72M, 72K, 72C, and 72Y is provided so as to extend in a direction perpendicular to the conveying direction of the recording medium 24 (the rotation direction of the image formation drum 70).

The droplets of corresponding color ink are ejected from each of the inkjet heads 72M, 72K, 72C, and 72Y toward the recording surface of the recording medium 24 in close contact with and held on the image formation drum 70, whereby ink comes into contact with the processing liquid applied to the recording surface in advance by the processing liquid application unit 14, the color material (pigment) dispersed in ink is aggregated, and a color material aggregate is formed. Accordingly, a color material flow or the like on the recording medium 24 is prevented, and an image is formed on the recording surface of the recording medium 24.

In this example, although a configuration of reference colors (four colors) of C (cyan), M (magenta), Y (yellow), and K (black) is illustrated, a combination of ink colors or the number of colors is not limited to this embodiment, and if necessary, light ink, deep ink, and special color ink may be added. For example, a configuration may be applied in which an inkjet head capable of ejecting light ink, such as light cyan or light magenta, is added, and the the respective color heads may be arranged in any order.

The recording medium 24 with an image formed thereon by the image formation unit 16 is delivered from the image formation drum 70 to a drying drum 76 of the drying unit 18 through the intermediate conveying unit 28.

(Drying Unit)

The drying unit 18 is a mechanism which dries moisture included in the solvent separated by a color material aggregation action, and as shown in FIG. 1, includes a drying drum 76 and a solvent driving device 78.

Similarly to the processing liquid drum 54, the drying drum 76 includes a claw-shaped holding unit (gripper) 77 on the outer circumferential surface, and is configured to hold the leading end of the recording medium 24 by the holding unit 77.

The solvent drying device 78 is arranged at a position facing the outer circumferential surface of the drying drum 76, and has a plurality of IR heaters 82 and warm air jet nozzles 80 arranged between the IR heaters 82.

The temperature and air capacity of warm air blown from each warm air jet nozzle 80 toward the recording medium 24 and the temperature of each IR heater 82 are appropriately adjusted, thereby realizing various drying conditions.

The surface temperature of the drying drum 76 is set to be equal to or higher than 50° C. Heating is performed from the rear surface of the recording medium 24 to accelerate drying, thereby preventing image breakdown during fixing. Although the upper limit of the surface temperature of the drying drum 76 is not particularly limited, from the viewpoint of safety (prevention of burn by high temperature) of a maintenance operation, such as cleaning of ink stuck to the surface of the drying drum 76, it is preferable that the upper limit of the surface temperature of the drying drum 76 is set to be equal to or lower than 75° C. (more preferably, equal to or lower than 60° C.).

The recording medium 24 is held on the outer circumferential surface of the drying drum 76 such that the recording surface of the recording medium 24 turns outward (that is, the recording medium 24 is curved such that the recording surface of the recording medium 24 becomes a convex side) and dried while being rotated and conveyed, thereby preventing the occurrence of wrinkling or floating of the recording medium 24 and thus reliably preventing drying irregularity due to wrinkling or floating.

The recording medium 24 dried by the drying unit 18 is delivered from the drying drum 76 to a fixing drum 84 of the fixing unit 20 through the intermediate conveying unit 30.

(Fixing Unit)

The fixing unit 20 has a fixing drum 84, a halogen heater 86, a fixing roller 88, and an inline sensor 90. Similarly to the processing liquid drum 54, the fixing drum 84 includes a claw-shaped holding unit (gripper) 85 on the outer circumferential surface, and is configured to hold the leading end of the recording medium 24 by the holding unit 85.

With the rotation of the fixing drum 84, the recording medium 24 is conveyed such that the recording surface turns outward, and for the recording surface, preliminary heating by the halogen heater 86, fixing by the fixing roller 88, and inspection by the inline sensor 90 are performed.

The halogen heater 86 is controlled at a predetermined temperature (for example, 180° C.). Accordingly, preliminary heating of the recording medium 24 is performed.

The fixing roller 88 is a roller member which heats and pressurizes the dried ink to weld self-dispersion thermoplastic resin particulates and coats ink, and is configured to heat and pressurize the recording medium 24. Specifically, the fixing roller 88 is arranged so as to be pressed against the fixing drum 84, and is configured to form a nip roller along with the fixing drum 84. Accordingly, the recording medium 24 is sandwiched between the fixing roller 88 and the fixing drum 84 and nipped at a predetermined nip pressure (for example, 0.15 MPa), and fixing is performed.

The fixing roller 88 is constituted by a heating roller in which a halogen lamp is incorporated in a metal pipe, such as aluminum having excellent thermal conductivity, and is controlled at a predetermined temperature (for example, 60 to 80° C.) The recording medium 24 is heated by the heating roller, whereby thermal energy equal to or higher than Tg temperature (glass transition point temperature) of the thermoplastic resin particulates included in ink is applied and the thermoplastic resin particulates are molten. Accordingly, plunging fixing is performed in the unevenness of the recording medium 24, the unevenness of the image surface is leveled, and glossiness is obtained.

In the embodiment of FIG. 1, although a configuration is applied in which the single fixing roller 88 is provided, another configuration may be applied, for example, in which a plurality of stages are provided according to the thickness of the image layer or the Tg characteristics of the thermoplastic resin particulates.

The inline sensor 90 is a measurement unit which measures a check pattern, the amount of moisture, surface temperature, glossiness, or the like for the image fixed to the recording medium 24, and a CCD line sensor or the like is applied.

According to the fixing unit 20 configured as above, since the thermoplastic resin particulates in the thin image layer formed by the drying unit 18 is heated and pressurized by the fixing roller 88 and molten, the image can be fixed onto the recording medium 24. The surface temperature of the fixing drum 84 is set to be equal to or higher than 50° C., whereby the recording medium 24 held on the outer circumferential surface of the fixing drum 84 is heated from the rear surface and accelerated to be dried, thereby presenting image breakdown during fixing and increasing image intensity by the effect of increasing image temperature.

When a UV curable monomer is contained in ink, moisture is volatilized by the drying unit, then UV is irradiated onto the image by the fixing unit including a UV irradiation lamp, and the UV curable monomer is cured and polymerized, thereby improving image intensity.

(Sheet Discharge Unit)

As shown in FIG. 1, the discharge unit 22 is provided to follow the fixing unit 20. The discharge unit 22 includes a discharge tray 92, and a transfer cylinder 94, a conveying belt 96, and a tension roller 98 are provided between the discharge tray 92 and the fixing drum 84 of the fixing unit 20 so as to be placed against the discharge tray 92 and the fixing drum 84 of the fixing unit 20. The recording medium 24 is transferred to the conveying belt 96 by the transfer cylinder 94 and discharged to the discharge tray 92.

Though not shown, in addition to the above-described configuration, the inkjet recording apparatus 10 of this example includes an ink storage/load unit which supplies ink to each of the inkjet heads 72M, 72K, 72C, and 72Y, a unit which supplies the processing liquid to the processing liquid application unit 14, a head maintenance unit which performs cleaning (wiping of the nozzle surface, purging, nozzle absorption, and the like) of each of the inkjet heads 72M, 72K, 72C, and 72Y, a position detection sensor which detects the position of the recording medium 24 on a sheet conveying path, a temperature sensor which detects the temperature of each unit of the apparatus, and the like.

Figure 2:
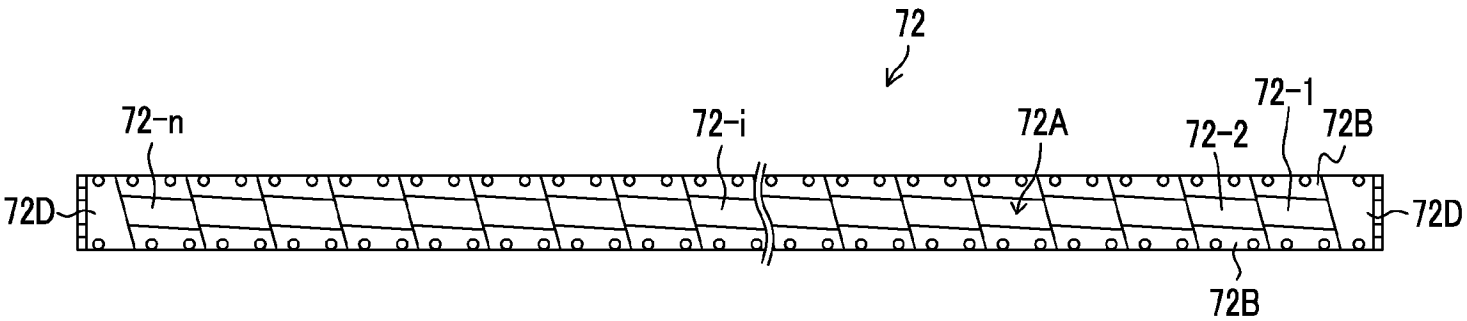
FIG. 2 is a plan view showing a configuration example of an inkjet head shown in FIG. 1.
Figure 3:
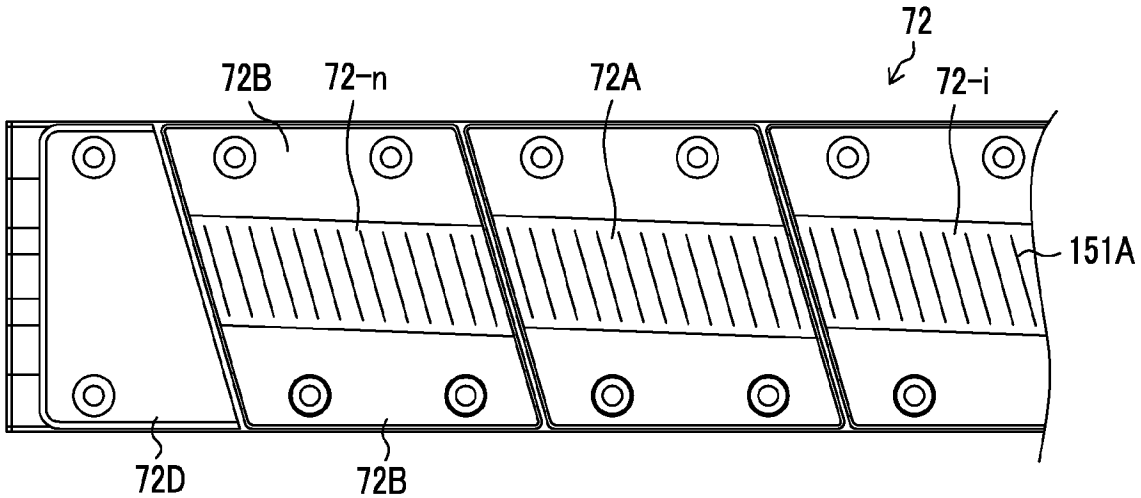
FIG. 3 is a partial enlarged view of FIG. 2.

FIG. 2 is a plan view showing a structure example of the head 72 and is a diagram when the head 72 is viewed from a nozzle surface 72A. FIG. 3 is a partial enlarged view of FIG. 2.

As shown in FIG. 2, the head 72 has a structure in which n head modules 72-*i* (where i=1, 2, 3, . . . , n) are linked with each other in a longitudinal direction (a direction perpendicular to the conveying direction of the recording medium 24 (see FIG. 1)), and a plurality of nozzles (not shown in FIG. 2) are provided over the length corresponding to the overall width of the recording medium.

Each head module 72-*i* is supported by a head module support member 72B from both sides in a transverse direction of the head 72. Both ends in the longitudinal direction of the head 72 are supported by a head support member 72D.

As shown in FIG. 3, each head module 72-*i* (n-th head module 72-*n*) has a structure in which a plurality of nozzles are arranged in a matrix. In FIG. 3, an oblique solid line with reference numeral 151A indicates a nozzle column in which a plurality of nozzles are arranged in a column.

Figure 4A:
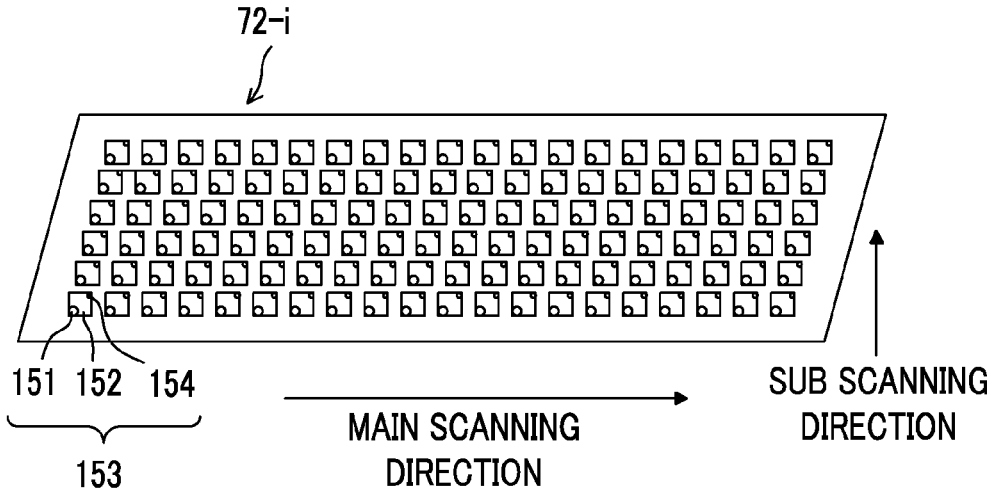
FIGS. 4A and 4B are perspective plan views of a head module shown in FIG. 2.
Figure 4B:
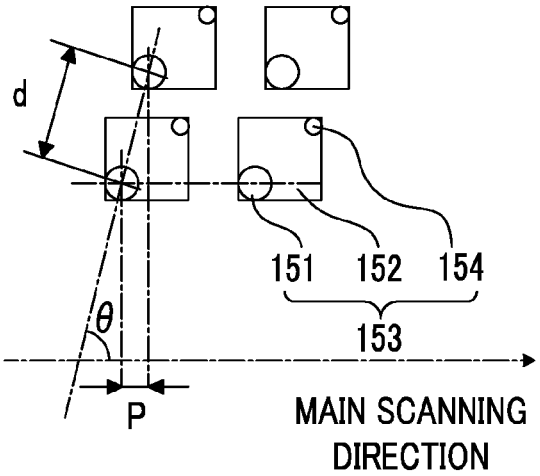

FIG. 4A is a perspective plan view of the head module 72-*i*, and FIG. 4B is an enlarged view of a part of FIG. 4A.

In order to densify a dot pitch formed on the recording medium 24, it is necessary to densify a nozzle pitch in the head 72. As shown in FIGS. 4A and 4B, the head module 72-*i* of this example has a structure in which a plurality of ink chamber units (i.e., droplet ejection element as a recording element unit) 153 each having a nozzle 151 as an ink ejection port, a pressure chamber 152 corresponding to each nozzle 151, and the like are arranged in a zigzag pattern and in a matrix (in a two-dimensional manner), thereby attaining densification of a substantial nozzle interval (i.e., projection nozzle pitch) so as to be arranged in the head longitudinal direction (i.e., the direction perpendicular to the conveying direction of the recording medium 24; main scanning direction).

The pressure chamber 152 provided corresponding to each nozzle 151 substantially has a planar shape of a square, the nozzle 151 is provided at one of both corners on the diagonal, and a supply port 154 is provided at the other corner. The shape of the pressure chamber 152 is not limited to this example, and the planar shape may have various forms including a polygon, such as a quadrangle (rhombus, rectangle, or the like), a pentagon, or a hexagon, a circle, an ellipse, and the like.

As shown in FIG. 4B, multiple ink chamber units 153 having the above-described structure are arranged in a given arrangement pattern and in a lattice shape along a row direction along the main scanning direction and an oblique column direction at a given angle θ not perpendicular to the main scanning direction, thereby realizing a densified nozzle head of this example.

That is, with a structure in which a plurality of ink chamber units 153 at a given pitch d in the direction at the angle θ with respect to the main scanning direction, the pitch P of the nozzles projected so as to be arranged in the main scanning direction becomes d×cos θ, and in the main scanning direction, this structure can be equivalent to a structure in which the nozzles 151 are arranged linearly at a given pitch P. With this configuration, a densified nozzle configuration in which a nozzle column projected so as to be arranged in the main scanning direction reaches 2400 per inch (2400 nozzles/inch) can be realized.

The nozzle arrangement structure according to an embodiment of the present invention is not limited to the example shown in the drawing, and various nozzle arrangement structures, such as an arrangement structure having a column of nozzles in the sub-scanning direction, may be applied.

Figure 5A:
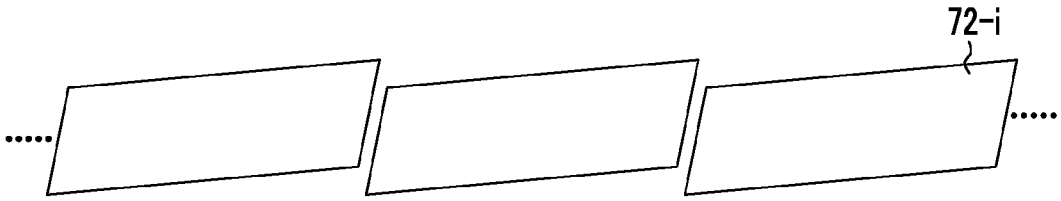
FIGS. 5A to 5C are diagrams showing other examples of the shape of a nozzle surface of a head module.
Figure 5B:
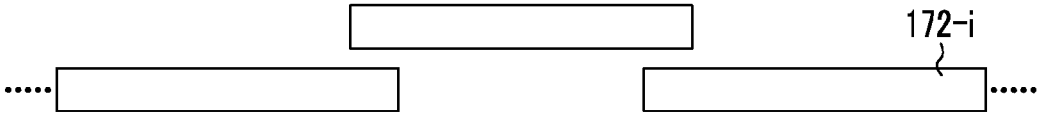
Figure 5C:
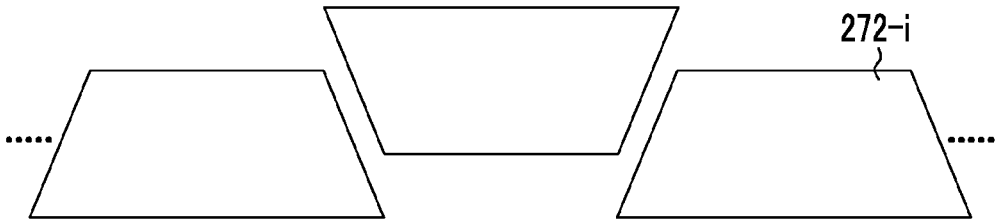

FIGS. 5A to 5C are diagrams showing other examples of the shape of a nozzle surface of a head module. The shape of the nozzle surface of the head module is not limited to a parallelogram shown in FIGS. 2 and 5A, and rectangular head modules 172-*i* as shown in FIG. 5B may be arranged so as to partially overlap each other, thereby obtaining an elongated inkjet head in the main scanning direction. As shown in FIG. 5C, an inkjet head in which trapezoidal head modules 272-*i* are alternately aligned while flipping vertically and arranged so as to partially overlap each other may be used.

[Description of Control System]

Figure 6:
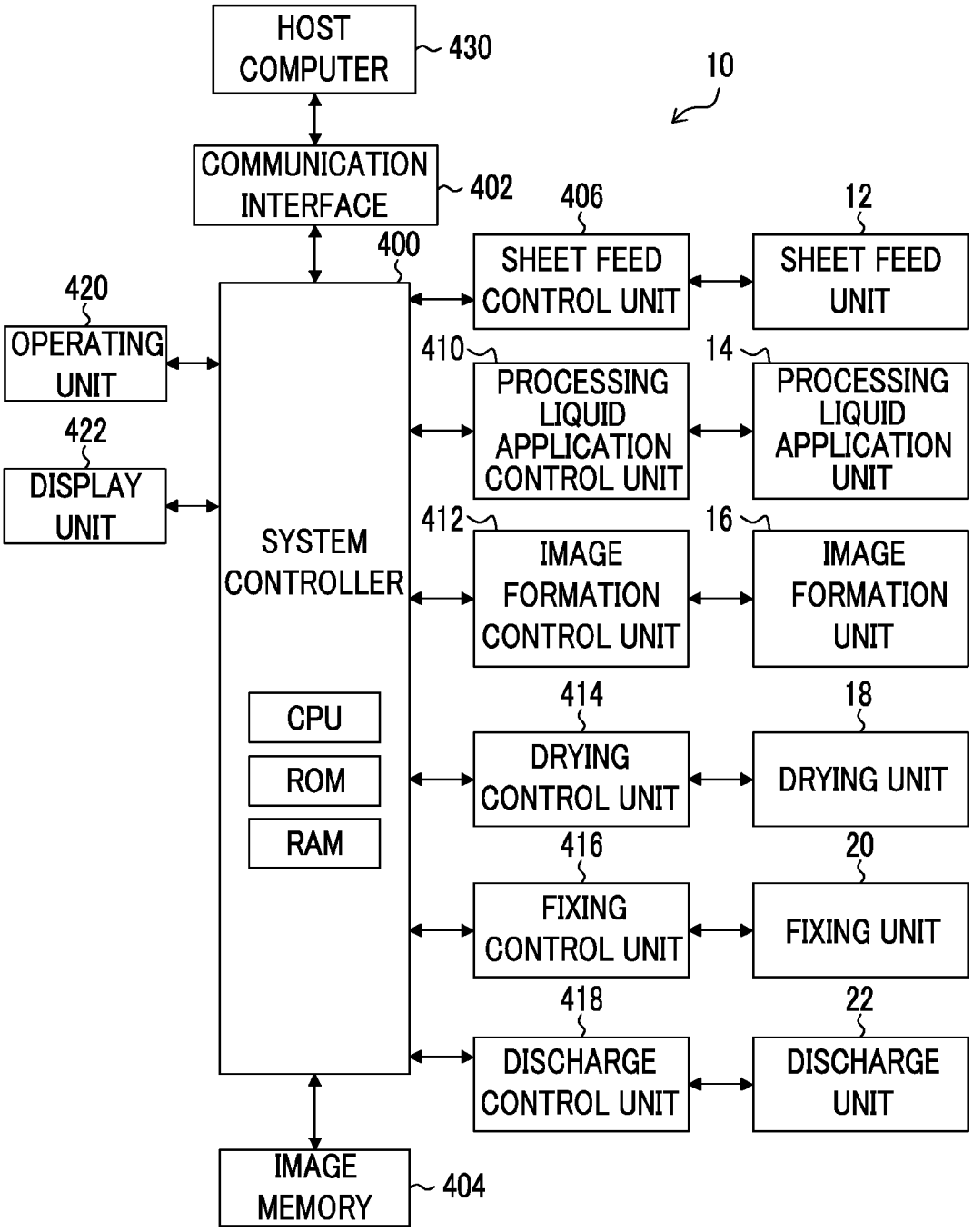
FIG. 6 is a block diagram of a main part constituting a system of an inkjet recording apparatus.

FIG. 6 is a block diagram showing the schematic configuration of a control system of the inkjet recording apparatus of this embodiment.

As shown in the drawing, the inkjet recording apparatus 10 includes a system controller 400, a communication interface 402, an image memory 404, a sheet feed control unit 406, a processing liquid application control unit 410, an image formation control unit 412, a drying control unit 414, a fixing control unit 416, a discharge control unit 418, an operating unit 420, a display unit 422, and the like.

The system controller 400 is a control unit which controls the respective units of the inkjet recording apparatus 10 and also serves as an arithmetic processing unit which performs various kinds of arithmetic processing. The system controller 400 includes a CPU, a ROM, a RAM, and the like. The system controller 400 controls the respective units of the inkjet recording apparatus 10 according to a predetermined control program. The ROM stores a control program which is executed by the system controller 400 or various kinds of data necessary for control.

The communication interface 402 is an interface unit which receives image data sent from a host computer 430. Image data sent from the host computer 430 is loaded into the inkjet recording apparatus 10 through the communication interface 402.

The image memory 404 is a memory unit which temporarily stores image data, and data reading/writing is performed through the system controller 400 Image data loaded from the host computer 430 through the communication interface 402 is stored in the image memory 404.

The sheet feed control unit 406 controls the driving of the respective units (sheet feed cylinder 52 and the like) constituting the sheet feed unit 12 according to a command from the system controller 400.

The processing liquid application control unit 410 controls the driving of the respective units (processing liquid drum 54, processing liquid coating device 56, and the like) constituting the processing liquid application unit 14 according to a command from the system controller 400.

The image formation control unit 412 controls the driving of the respective units (image formation drum 70, inkjet heads 72M, 72K, 72C, and 72Y, and the like) constituting the image formation unit 16 according to a command from the system controller 400.

The drying control unit 414 controls the driving of the respective units (drying drum 76, solvent drying device 78, and the like) constituting the drying unit 18 according to an instruction from the system controller 400. The drying control unit 414 also controls the temperature of the drying drum 76.

The fixing control unit 416 controls the driving of the respective units (fixing drum 84, halogen heater 86, fixing roller 88, and the like) constituting the fixing unit 20 according to an instruction from the system controller 400.

The discharge control unit 418 controls the driving of the respective units (transfer cylinder 94, conveying belt 96, and the like) constituting the discharge unit 22 according to an instruction from the system controller 400.

The operating unit 420 includes a required operating unit (operating button, keyboard, touch panel, or the like), and outputs operation information from the operating unit to the system controller 400.

The display unit 422 includes a required display device (LCD panel or the like), and causes the display device to display required information according to an instruction from the system controller 400.

As described above, image data is loaded from the host computer 430 into the inkjet recording apparatus 10 through the communication interface 402, and is stored in the image memory 404. The system controller 400 performs required signal processing on image data stored in the image memory 404 to generate dot data. The driving of the inkjet heads 72M, 72K, 72C, and 72Y of the image formation unit 16 is controlled according to the generated dot data, and an image represented by the image data is printed on the recording medium 24.

In general, the dot data is generated by performing color conversion processing and halftone processing on the image data.

The color conversion processing is processing for converting image data (for example, RGB 8-bit image data) expressed by sRGB or the like to color data (in this example, color data of KCMY) of each color of ink to be used in the inkjet recording apparatus.

The halftone processing is processing for converting color data of each color generated by the color conversion processing to dot data (in this example, dot data of KCMY) of each color through processing, such as error diffusion.

The system controller 400 performs the color conversion processing and the halftone processing on image data to generate dot data of each color of CMYK. The driving of a corresponding one of the inkjet heads 72M, 72K, 72C, and 72Y is controlled according to the generated dot data of each color, and an image represented by the image data is printed on the recording medium 24.

[Method for Adjusting Head Module]

Next, a method for adjusting a head module will be described. The inkjet head is manufactured using a method for adjusting a head module described below, thereby linking the head modules together in a direction to cancel the landing interference. Therefore, it is possible to prevent degradation of image quality due to deviation when linking the head modules together.

(First Embodiment)

Figure 7A:
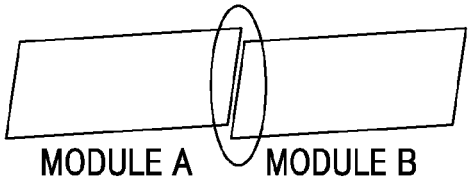
FIGS. 7A and 7B are diagrams showing nozzle arrangement near a head module link portion.
Figure 7B:
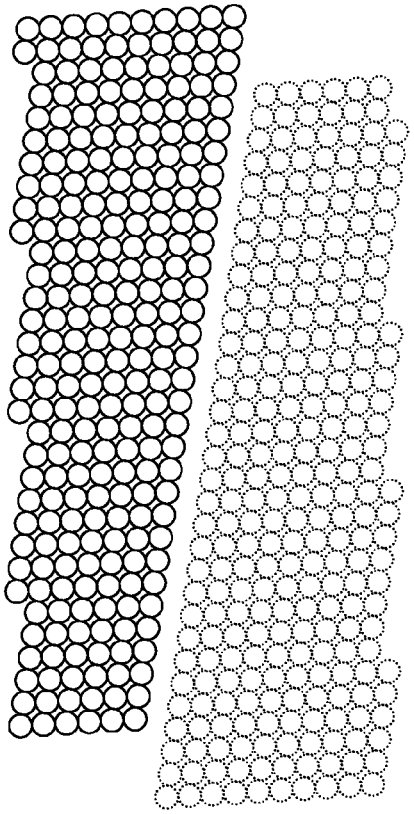
Figure 8:
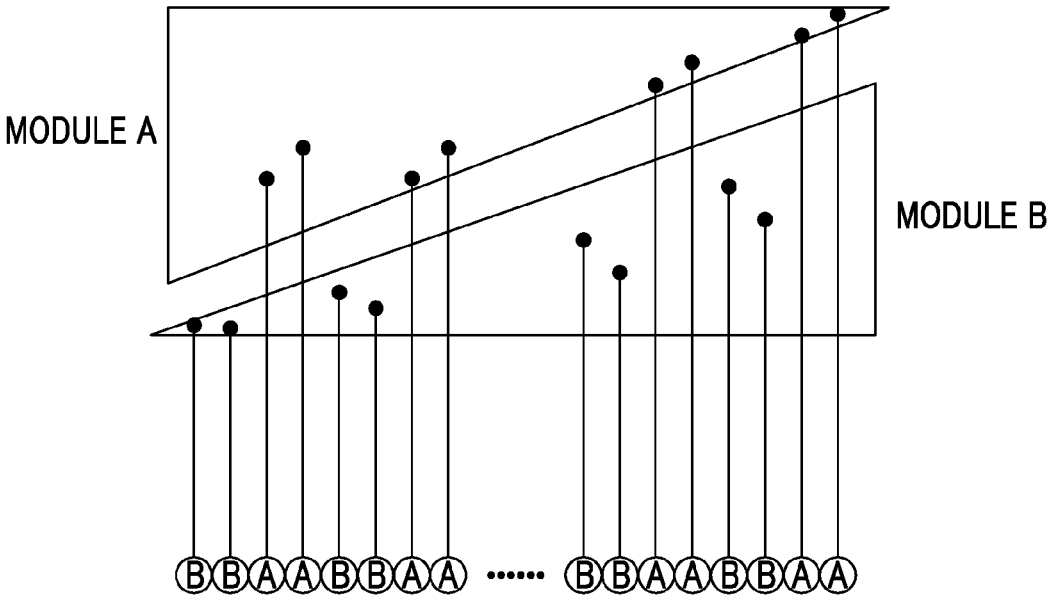
FIG. 8 is a diagram showing the relationship between an emission position near a head module link portion and a head module.

FIG. 7A is a diagram of an inkjet head bar viewed from the top surface, which inkjet head bar uses a head module having a parallelogram nozzle surface shown in FIG. 2. In FIG. 7A, the left side is a head module A (first head module), and the right side is a head module B (second head module). FIG. 7B is an enlarged view of a link portion of the head module A and the head module B, and the nozzles are indicated by circles. FIG. 8 is a schematic view showing the relationship between the alignment of nozzles when droplets are ejected in a link portion and the head module used for the ejected dots. In the head module of this embodiment, the number of nozzles in the overlapping region of the link portion is 96 (about 2 mm width). In regard to the 96 nozzle portions, the alignment of BBAA is repeated 24 times. The alignment of the nozzles is not limited thereto, the link portion changes according to head modules to be used, for example, BAAA, BBBA, or the like may be used, and the present invention may be applied to an inkjet head bar having any alignment.

An overlapping region (also referred to as "link region") in which the alignment of the head modules for the ejected dots and the actual alignment of the head modules are opposite to each other near the link portion of the head modules is formed by nozzles on the sheet discharge side of one head module (head module A) and nozzles on the sheet feed side of the other head module (head module B).

Hereinafter, an explanation will be made taking the nozzle arrangement shown in FIGS. 7A, 7B, and 8 as an example. FIG. 9 shows a pixel number counted from the head module A side to the head module B side, the type of head module, and a landing sequence in the region of the link portion which has 96 nozzles. The pixel number in FIG. 9 is the sequence of the head modules of FIGS. 7A and 7B counted from the head module A side to the head module B side. The landing sequence is a relative landing sequence between neighboring nozzles. That is, for example, in FIG. 9, although the pixel number 1, the pixel number 5 and the pixel number 9 all correspond to the landing sequence "1", this does not mean that they are ejected simultaneously.

Next, the relationship between link positioning precision of a head module and the ejected dots will be described. FIGS. 10A to 10D are diagrams showing the relationship between the position of a head module and the ejected droplets. The link positioning precision of the head module is represented by $\Delta x$. The link positioning precision $\Delta x$ of the head module is described by the difference from $\Delta x=0$. When $\Delta x=0$ μm, it means that, in the head module link region, the head modules are linked together such that the ejection of droplets are performed with the same width as the nozzles arranged in each head module. That is, when the nozzles of the head module are arranged with 1200 dpi, if $\Delta x=0$ μm, it is defined that the nozzles are aligned with print resolution of 1200 dpi even in the link region.

Figure 10A:
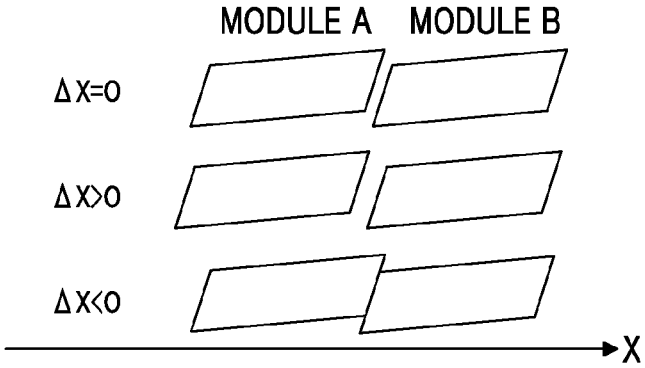
FIGS. 10A to 10D are diagrams showing the relationship between the position of a head module and ejected droplets.
Figure 10B:
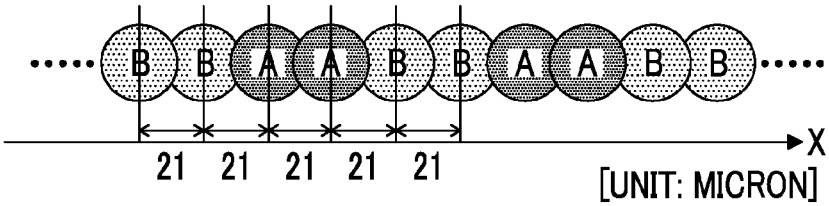
Figure 10C:
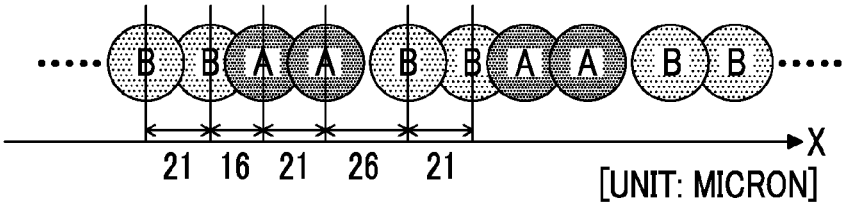
Figure 10D:
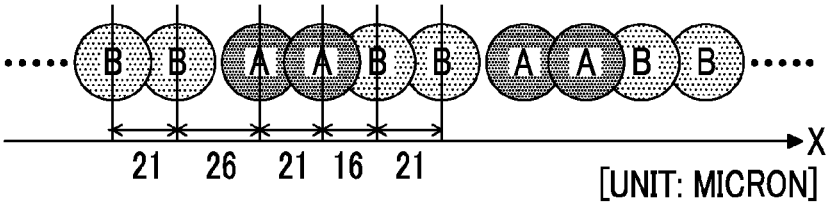

Accordingly, as shown in FIGS. 10A and 10B, when $\Delta x=0$, the head modules are aligned such that the dots are ejected with a uniform width. When $\Delta x>0$ ($\Delta x$ is a positive number), as shown in FIGS. 10A and 10C, this defines the direction in which the left head module A and the right head module B are away from each other. When $\Delta x<0$ ($\Delta x$ is a negative number), as shown in FIGS. 10A and 10D, this defines the direction in which the distance between the left head module A and the right head module B approach each other.

In this embodiment, since ejection of droplets is performed with 1200 dpi, the dots are ejected uniformly at an interval of about 21 μm (exactly, 21.17 μm) As shown in FIG. 10B, when Δx=0, the dots are ejected uniformly at an interval of about 21 μm. As shown in FIG. 10C, for example, when Δx=5 μm (Δx>0), in the nozzle arrangement of BBAABB, the interval from B to A decreases by 5 μm and becomes 16 μm, and the interval from A to B increases by 5 μm and becomes 26 μm. To the contrary, as shown in FIG. 10D, when Δx=−5 μm (Δx<0), in the nozzle arrangement of BBAABB, the interval from A to B decreases by 5 μm and becomes 16 μm, and the interval from B to A increases by 5 μm and becomes 21 μm. Accordingly, if the absolute value of Δx increases, since the interval between the dot ejected from the head module A and the dot ejected from the head module B increases, the white space between the dots is visually recognized and density changes, causing degradation of image quality of the head module link portion.

In regard to degradation of image quality in the head module link portion, there is concern that ink landed on the recording medium is moved by the influence of landing interference as described below, and image quality is degraded. Hereinafter, the landing interference will be described.

Figure 11A:
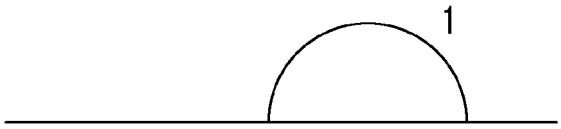
FIGS. 11A and 11B are diagrams illustrating landing interference.
Figure 11B:
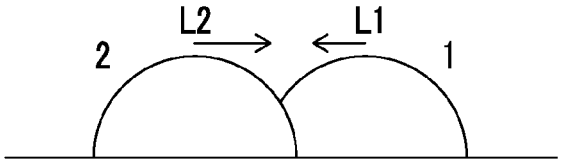

FIGS. 11A and 11B are diagrams illustrating the landing interference, and the landing interference between two droplets will be described as a basic idea. FIG. 11A is a diagram showing after a first droplet is landed, and FIG. 11B is a diagram showing after a second droplet is landed.

When the second droplet is landed, the droplet ejected first and the droplet ejected second come into contact with each other, whereby the first droplet and the second droplet are moved in a direction to get close to each other. In this embodiment, the movement distance L1 of the first droplet is about 2 μm, and the movement distance L2 of the second droplet is about 4 μm. That is, the displacement L2 of the second droplet relatively increases. The movement distances L1 and L2 depend on liquid volume, resolution, ink, paper type, preprocessing onto paper, and the like. In this embodiment, the liquid volume is 2.0 pL, and the resolution is 1200 dpi. Aqueous pigment ink and gross paper are used, and an aggregation processing liquid is applied to the gross paper as the preprocessing.

The time which takes the droplets to penetrate into paper until they are not influenced by the landing interference is about 10 ms. In a case of high-speed single pass of this embodiment, since the time until adjacent dots are landed is 3 ms to 7 ms, it is not possible to neglect the influence due to the landing interference.

Figure 12:
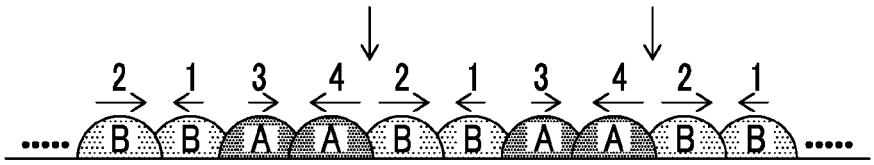
FIG. 12 is a diagram illustrating a landing sequence in nozzle arrangement of the first embodiment and landing interference.

Next, a method for adjusting a head module taking the landing interference into consideration will be described. FIG. 12 is a diagram showing the relationship between a landing sequence of the nozzle arrangement shown in FIG. 9 and the landing interference. As shown in FIG. 12, the ejection of droplets is performed in a sequence of the head modules BBAABBAABB from the left side of the FIG. 9, and the ejection sequence is 2134213421. In this case, the landing interference occurs between a dot second ejected and a dot first ejected. Also, the landing interference occurs between a dot third ejected and a dot fourth ejected. The arrows in FIG. 12 represent the displacement of the dots. In FIG. 12, L1 shown in FIG. 11B is represented by a short arrow, and L2 is represented by a long arrow. In FIG. 12, the dot second ejected is moved toward the dot first ejected, and the dot fourth ejected is moved toward the dot third ejected. As a result, during high density printing in which there are many adjacent dots, as indicated by the arrows (the vertical direction with respect to the spread of the droplet) in FIG. 12, the interval between the droplet second landed and the droplet fourth landed is likely to increase most by the influence of landing interference. The dot third landed undergoes the landing interference with the dot first landed. However, since the dot first landed is advanced to penetrate into the recording medium, it is assumed in this embodiment that the dot first landed and the dot third landed are not influenced by the landing interference.

Accordingly, since the interval from A to B of the alignment of the dots AABB increases due to the landing interference, the link positioning precision Δx of the head modules is adjusted in a manner so that the head modules are adjusted in the direction to decrease the interval of AB, that is, in the direction of Δx<0 as described with reference to FIGS. 10A to 10D.

Next, a head module adjustment position will be described. The position of the head module is adjusted taking the landing interference into consideration. Specifically, the head module adjustment position is determined by the following method.

The image quality of the head module link region is confirmed while changing the link positioning precision Δx of the head module A and the head module B. The image quality is determined based upon the presence/absence of streak and shading of image of a monochromatic density patch of 50 to 100% compared to a sample. The determination is evaluated according to the following criteria.

A: There is no shading in the image, and no streak is formed.

B: There is irregularity in density of image, streak(s), and white portion(s) that is visually recognized.

The result is shown in FIG. 13. As shown in FIG. 13, in this embodiment, the range in which image quality is satisfied is −11 μm<Δx<+5 μm. Accordingly, in this embodiment, the head modules are adjusted with the Δx=−3 μm as a target, which is the center of this satisfying range (i.e., allowable range). As shown in FIG. 13, if Δx=0 μm, the image quality in the head module link portion is allowable even if the image quality is influenced by the landing interference. However, it is not simple to obtain the head module of Δx=0 μm with high yield, it is technically difficult to perform adjustment with high precision (i.e., yield is low), and an expensive alignment device is required (increase in cost due to investment in facilities). For this reason, the head is manufactured with Δx being varied within a certain range. Therefore, since the head is manufactured in a manner such that Δx falls within the allowable range shown in FIG. 13, the head is manufactured with Δx=−3 μm as a target, which is the center of a range satisfying image quality, thereby achieving the allowable range shown in FIG. 13 even if the position of Δx is deviated.

[Relationship Between Δx and Alignment Position]

Next, a mechanism for maintaining asymmetry when Δx is positive and negative will be described below.

<<When Δx>0>>

Figure 14A:
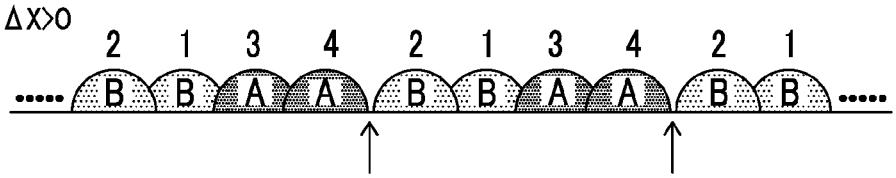
FIGS. 14A and 14B show the relationship between positioning precision of a head module and a landing position of a droplet.

FIG. 14A shows the relationship of a landing position when Δx>0 in the case where the landing sequence is as shown in FIG. 9 When Δx>0, that is, the head modules are provided such that the interval between the head module A and the head module B increases, whereby the distance between AB in the alignment of AABB indicated by an arrow in FIG. 14A increases. With regard to the landing interference, the interval between the droplet second landed and the droplet fourth landed, that is, the distance between AB increases. In this way, the interval between the droplet second landed and the droplet fourth landed increases synergistically by the influence of $\Delta x>0$ and the influence by the landing interference. As a result, in the head module link portion, the image quality is likely to be deteriorated. Although the value of $\Delta x$ causing the image deterioration cannot easily specified since image quality is influenced by factors other than $\Delta x$, in an experiment, the image quality of the head module link portion is satisfying when $\Delta x>5$ μm.

<<When $\Delta x<0$>>

Figure 14B:
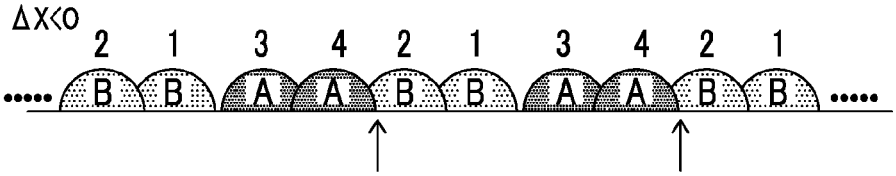

FIG. 14B shows the relationship of a landing position when $\Delta x<0$ in the case where the landing sequence is as shown in FIG. 9. The head modules are provided such that $\Delta x<0$, that is, the interval between the head module A and the head module B decreases, whereby, contrary to when $\Delta x<0$, as indicated by the arrow in FIG. 14B, the distance between AB in the alignment of AABB decreases. With regard to the landing interference, similarly to FIG. 14A, the distance between AB increases due to the influence of the landing interference. Accordingly, when $\Delta x<0$, the change in the interval between AB is cancelled by the influence of $\Delta x<0$ and the influence of the landing interference, and as a result, image quality of the head module link portion is not likely to be deteriorated. In an experiment, image quality of the head module link portion is satisfying until $\Delta x<-11$ μm.

In this way, since the droplets are moved due to the landing interference, the center of the allowable range of $\Delta x$ is deviated is not from $\Delta x=0$ to either direction depending on a direction in which the droplets are moved due to the landing interference.

On the other hand, when $\Delta x=-3$ μm, there is concern about image quality in a case of low duty with no landing interference. However, in regard to this point, when density is low, since positional deviation of a few dots cannot be recognized visually, there is no problem. It is confirmed that, in an experiment in which an image is actually formed, there is no problem.

Although the allowable range of $\Delta x$ in which the image quality is satisfying is confirmed by an image quality confirmation experiment with $\Delta x$ being change in the above description, a place at which the interval is most likely to be formed may be found by a simulation of the landing interferences. Since the landing interference strongly depends on a sheet (recording medium), ink, preprocessing liquid, or the like, these can be used as parameters. When executing by the simulation, the displacement of the droplets of L1 and L2 can be used for calculation.

(Second Embodiment)

Figures 15, 16:
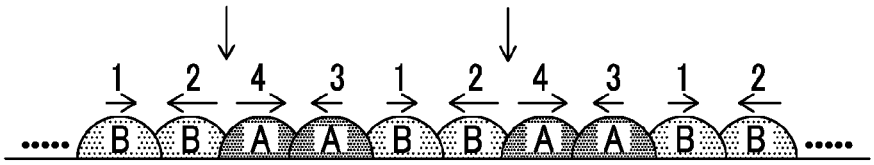
FIG. 15 is a table showing a pixel number counted from a head module A side to a head module B side, the type of head module, and a landing sequence according to a second embodiment.
FIG. 16 is a diagram illustrating a landing sequence in nozzle arrangement of the second embodiment and landing interference.

An inkjet head according to a second embodiment will be described. FIG. 15 shows the nozzle alignment of a landing sequence of nozzles different from the first embodiment. FIG. 15 is a diagram showing the relationship between a pixel number, a head module, and a landing sequence, and FIG. 16 is a diagram showing a landing sequence and the influence of landing interference.

In the second embodiment, as shown in FIG. 16, a droplet second landed and a droplet fourth landed is most likely to be influenced by the landing interference, and the interval therebetween increases (indicated by an arrow). The image quality of the link portion is confirmed while changing the link positioning precision $\Delta x$ of the head module A and the head module B. The result is shown in FIG. 17. As shown in FIG. 17, in the second embodiment, it can be confirmed that favorable image quality is obtained within the range of $-5$ μm$<\Delta x<11$ μm. Accordingly, the head modules are adjusted with the $\Delta x=3$ μm as a target, which is the center of this range, whereby, even if the positional deviation of the head modules occurs when manufacturing the inkjet head, since the positional deviation is likely to fall within the above-described range, thereby preventing the degradation of image quality by the adjustment of the positions of the head modules. When $\Delta x$ is positive ($\Delta x>0$), as shown in FIG. 10A, this defines the direction in which the distance between the head modules AB in the alignment of the head module A and the head module B increases. As shown in FIG. 10C, the interval between the droplets which are ejected from the head modules aligned in order of B and A decreases, and the interval between the droplets which are ejected from the head modules aligned in order of A and B increases. Accordingly, in the second embodiment, as shown in FIG. 16, since the droplets having the greatest interval due to the landing interference are the droplet second landed (head module B) and the droplet fourth landed (head module A), the link positioning precision $\Delta x$ of the head modules is set to be positive, thereby decreasing the interval between the droplets ejected from the head module B and the head module A. For this reason, it is possible to cancel the influence of the greatest interval due to the landing interference, and to obtain favorable image quality.

(Third Embodiment)

Figures 18, 19:
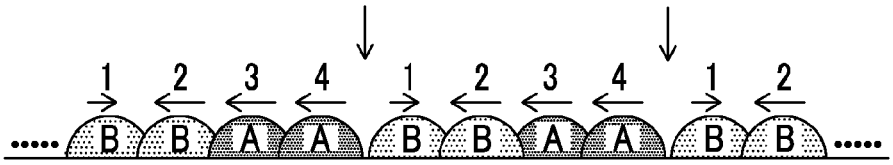
FIG. 18 is a table showing a pixel number counted from a head module A side to a head module B side, the type of head module, and a landing sequence according to a third embodiment.
FIG. 19 is a diagram illustrating a landing sequence in nozzle arrangement of the third embodiment and landing interference.

FIG. 18 shows nozzle alignment of a landing sequence of nozzles of a third embodiment. FIG. 18 is a diagram showing the relationship between a pixel number, a head module, and a landing sequence, and FIG. 19 is a diagram showing a landing sequence and the influence of landing interference.

In a third embodiment, as shown in FIG. 19, a droplet first landed and a droplet fourth landed are most likely to be influenced by the landing interference, and the interval therebetween increases. In order to confirm a positional deviation shift amount and image quality, an image is formed while changing the link positioning precision $\Delta x$ of the head module A and the head module B, and the image quality of the link portion is confirmed. The result is shown in FIG. 20. As shown in FIG. 20, in the third embodiment, it can be confirmed that favorable image quality is obtained within the range of $-10$ μm$<\Delta x<6$ μm. Accordingly, in the third embodiment, the head modules are adjusted with $\Delta x=-2$ μm as a target, which is the center of this range, thereby allowing the image quality is likely to fall within the above-described range even if the positional deviation of the head modules occurs. For this reason, it is possible to prevent degradation of image quality by the adjustment of the positions of the head modules. When $\Delta x$ is negative ($\Delta x<0$), as shown in FIG. 10A, this refers to the direction in which the interval between the head modules BA in the alignment of the head module A and the head module B increases. As shown in FIG. 10D, the interval between the droplets which are ejected from the head modules aligned in order of B and A increases, and the interval between the droplets which are ejected from the head modules aligned in order of A and B decreases. Accordingly, in the third embodiment, as shown in FIG. 19, since the droplets having the greatest interval due to the landing interference are the droplet fourth landed (head module A) and the droplet first landed (head module B), the link positioning precision $\Delta x$ of the head modules is set to be negative, thereby decreasing the interval between the droplets ejected from the head module A and the head module B. For this reason, it is possible to cancel the influence of the greatest interval due to the landing interference, and to obtain favorable image quality.

<Arrangement of Pattern by Droplet Sequence>

Figure 21A:
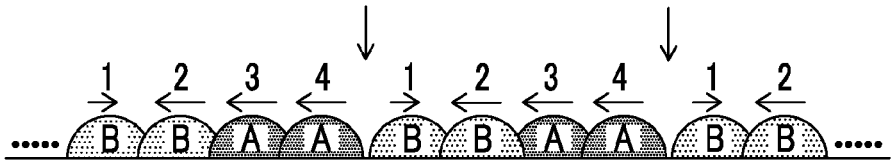
FIGS. 21A to 21F are diagrams showing a pattern in an emission sequence of four droplets.
Figure 21B:
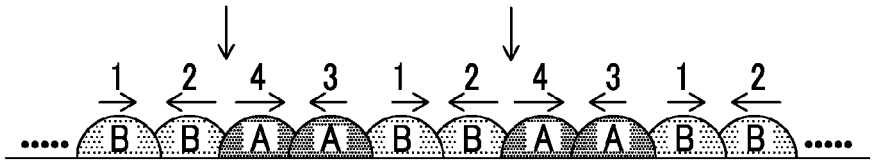
Figure 21C:
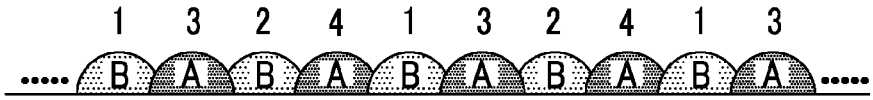
Figure 21D:
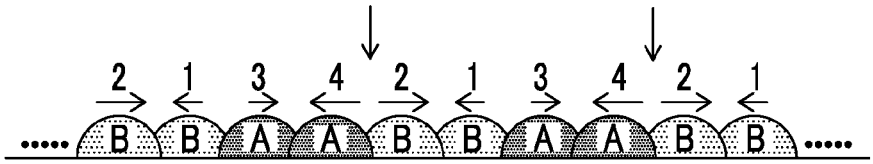
Figure 21E:
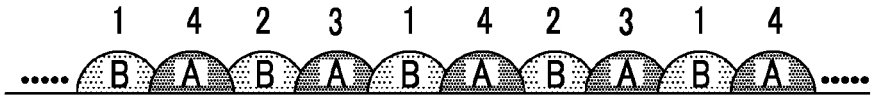

FIGS. 21A to 21F show a pattern of an ejection sequence of four droplets and the influence of landing interference. In the ejection sequence of the four droplets, although there are six patterns of FIGS. 21A to 21F, the landing sequence is aligned in opposite directions in FIGS. 21A and 21F, 21B and 21D, and 21C and 21E. For this reason, practically, there are three patterns. It is assumed that the first and second droplets are ejected from the head module B, and the third and fourth droplets are ejected from the head module A. FIG. 21D shows the above-described first embodiment, FIG. 21B shows the above-described second embodiment, and FIG. 21A shows the above-described third embodiment. In FIGS. 21C and 21E, when adjacent droplets are ejected continuously, a droplet may be third landed in the vicinity of the droplet second landed. Meanwhile, in this case, the droplet second landed is ejected from the head module B, and the droplet third landed is ejected from the head module B. As shown in FIG. 8, while the droplets ejected from the same head module are ejected continuously, since it takes some time until the droplets are ejected from the different head module, the landing interference are not likely to occur. Since the droplet third landed is landed between the droplets first and second landed, there is little influence of landing interference, and landing interference is not likely to occur. Accordingly, in FIGS. 21C and 21E, the movement due to the landing interference is not likely to occur.

Figure 21F:
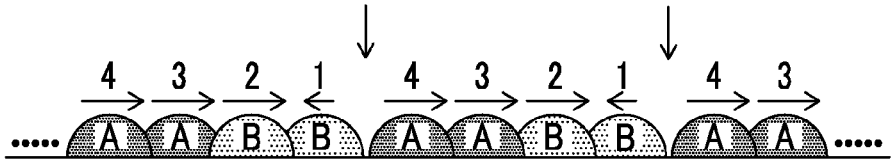

In the case of four droplets, in FIGS. 21A and 21F, the interval between the droplet first landed and the droplet fourth landed is greatest. In FIGS. 21B and 21D, the interval between the droplet second landed and the droplet fourth landed is greatest. Accordingly, it is preferable that, in regard to the link positioning precision Δx of the head modules, the adjustment direction of Δx is determined so as to cancel the position at which the interval between the droplets is greatest.

In the adjustment of the head modules, although the criterion differs depending on the type of ink, the center position for the adjustment of the head modules to be used for ink of other colors may be determined under the condition determined using black ink. The interval between dots due to the occurrence of landing interference is most likely to be recognized visually when the black ink is used. Accordingly, the range which satisfies the image quality determined by the black ink is the narrowest range. Therefore, even when the head modules of other kinds of ink are adjusted under the condition determined by the black ink, it is possible to obtain favorable image quality.

[Improvement of Image Quality by Enlargement of Dot Diameter]

In the above description, although the method for adjusting the link positioning precision Δx of the head modules taking landing interference into consideration has been described, the interval which increases due to the influence of landing interference is filled with ink by increasing the dot diameter with change in waveform, thereby preventing whitening.

(Fourth Embodiment)

In a fourth embodiment, the dot diameter increases while changing a driving voltage of a piezoelectric body (amplitude of a driving waveform), whereby the interval is filled with ink. It is confirmed that the dot diameter increases by about 5% by increasing a voltage of the driving waveform to be applied to the piezoelectric body by 10%.

Figure 22:
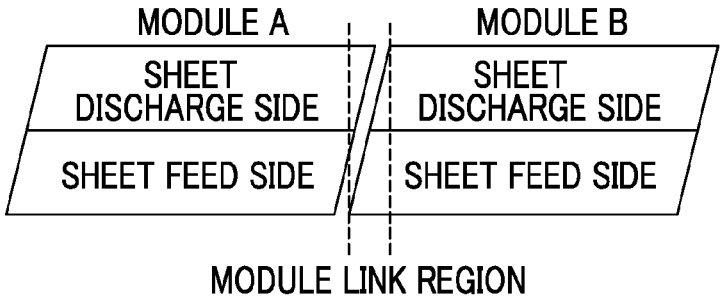
FIG. 22 is a diagram illustrating a head module link portion.
Figure 23A:
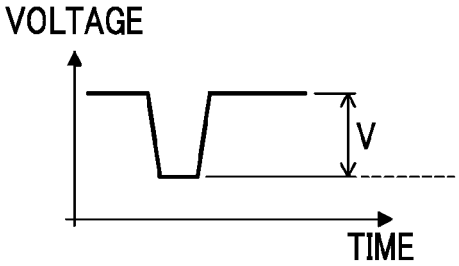
FIGS. 23A and 23B are diagrams illustrating a waveform at the time of ejection in a fourth embodiment.
Figure 23B:
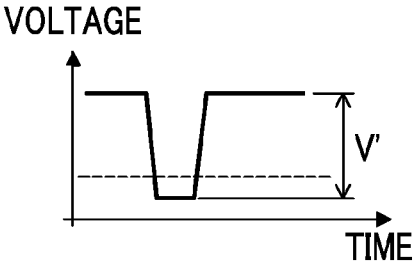

Each head module may be configured such that a control system is separated between the sheet feed side and the sheet discharge side with respect to the conveying direction of the recording medium. In this case, in the image formation control unit 412 of the block diagram of the control system shown in FIG. 6, different control systems may be provided on the sheet feed side and the sheet discharge side of the head module, and the waveform to be applied to the piezoelectric body may differ between the sheet feed side and the sheet discharge side. In a parallelogram head module shown in FIG. 22, in regard to the dots of the head module link portion, the link potion is formed by the nozzles on the sheet discharge side of the head module A and the sheet feed side of the head module B. FIGS. 23A and 23B show the shape of a waveform to be applied at the time of ejection. FIG. 23A shows a normal waveform, and FIG. 23B shows a waveform with voltage amplitude increased. The driving waveforms on the sheet discharge side of the head module A and on the sheet feed side of the head module B change as shown in FIG. 23B, and the voltage increases by 10%, thereby obtaining the effect of increasing the dot diameter. However, only if the voltage of the driving waveform increases, there is a problem in ejection stabilization. For this reason, the voltage on the sheet feed side of the head module A and the sheet discharge side of the head module B decreases by, for example, 5% (not shown), whereby density in a region other than the link region of the head modules can be adjusted appropriately.

Fifth Embodiment

In the fourth embodiment, while the dot diameter increases by increasing the voltage for driving the piezoelectric body, in a fifth embodiment, the droplet volume changes by adjusting the pulse width of the waveform for driving the piezoelectric body.

As in the fourth embodiment, the head module is configured such that a control system is separated between the sheet feed side and the sheet discharge side with respect to the conveying direction of the recording medium. In a parallelogram head module, the link portion of the head module is formed by the nozzles on the sheet discharge side of the head module A and the sheet feed side of the head module B. Accordingly, the dot diameter can be adjusted by changing the waveform voltage pulse on the sheet discharge side of the head module A and the sheet feed side of the head module B.

Figure 24A:
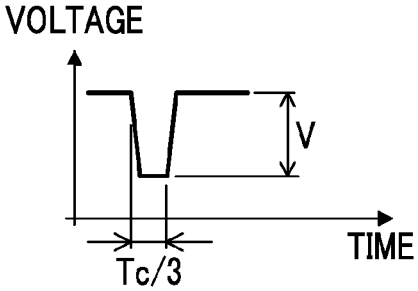
FIGS. 24A and 24B are diagrams illustrating a waveform at the time of emission in a fifth embodiment.
Figure 24B:
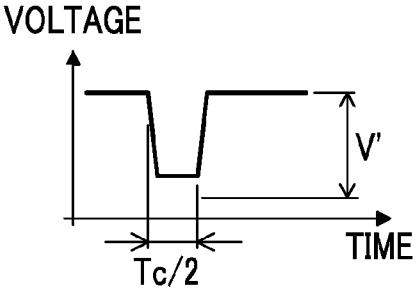

Specifically, the adjustment may be performed by the following method. As the normal waveform for ejecting ink, a pulse width at which discharge efficiency is not maximal is set (in FIG. 24A, for example, ⅓ of a resonance cycle Tc of a pressure chamber system). In contrast, the waveform pulse width on the sheet discharge side of the head module A and the sheet feed side of the head module B is set to maximum efficiency (half the resonance period Tc of the pressure chamber system) (FIG. 24B).

With this method, when the image quality of the link portion of the modules is not appropriate, the waveform pulse width of the link portion is set to maximum efficiency, thereby increasing the dot diameter of the link portion with a minimal influence.

In the fourth embodiment and the fifth embodiment, each may be executed alone, or the first embodiment to the third embodiment may be used together, thereby assisting the effects of the first embodiment to the third embodiment.

What is claimed is:

1. A method for adjusting a head module of an inkjet head in which a plurality of head modules having a plurality of nozzles capable of ejecting droplets are connected and linked together, the inkjet head having an overlapping region in which an arrangement sequence of the head modules corresponding to the ejected droplets becomes alternate between adjacent head modules, the method comprising the steps of:

obtaining, among intervals between the droplet ejected by one of the head modules and the droplet ejected by another one of the head modules in the overlapping region, a largest interval between the droplets in a direction of alignment of the head modules based upon movement of the droplets caused by a landing interference, which is an interaction between the droplets ejected from the nozzles of the head modules, the droplets being attracted to each other due to the interaction; and adjusting the adjacent head modules in a direction to decrease the largest interval between the droplets.

2. The method according to claim 1, wherein the largest interval between the droplets is determined according to a landing sequence of the droplets.

3. The method according to claim 1, wherein an image quality allowable range is obtained by ejecting the droplets while changing the interval between the adjacent head modules, and the head modules are adjusted with a center value of the image quality allowable range as a target.

4. The method according to claim 2, wherein an image quality allowable range is obtained by ejecting the droplets while changing the interval between the adjacent head modules, and the head modules are adjusted with a center value of the image quality allowable range as a target.

5. The method according to claim 1, wherein an image quality allowable range is obtained by a simulation by using at least one of a type of recording medium, a type of droplet, and a presence/absence of processing liquid application to the recording medium as a parameter, and the head modules are adjusted with a center value of the image quality allowable range as a target.

6. The method according to claim 2, wherein an image quality allowable range is obtained by a simulation by using at least one of a type of recording medium, a type of droplet, and a presence/absence of processing liquid application to the recording medium as a parameter, and the head modules are adjusted with a center value of the image quality allowable range as a target.

7. The method according to claim 1, wherein, due to the landing interference, a first droplet, which is first ejected, and a second droplet, which is ejected adjacent to the first droplet, are moved in a manner so that a movement distance of the second droplet is greater than a movement distance of the first droplet.

8. The method according to claim 2, wherein, due to the landing interference, a first droplet, which is first ejected, and a second droplet, which is ejected adjacent to the first droplet, are moved in a manner so that a movement distance of the second droplet is greater than a movement distance of the first droplet.

9. The method according to claim 3, wherein, due to the landing interference, a first droplet, which is first ejected, and a second droplet, which is ejected adjacent to the first droplet, are moved in a manner so that a movement distance of the second droplet is greater than a movement distance of the first droplet.

10. The method according to claim 4, wherein, due to the landing interference, a first droplet, which is first ejected, and a second droplet, which is ejected adjacent to the first droplet, are moved in a manner so that a movement distance of the second droplet is greater than a movement distance of the first droplet.

11. The method according to claim 1, wherein, when a link positioning precision of the head modules is $\Delta x$, $\Delta x>0$ is a direction of increasing a distance between adjacent head modules, and $\Delta x<0$ is a direction of decreasing the distance between adjacent head modules, when the alignment of the head modules is the same as the alignment of the head modules corresponding to the droplets having the largest interval due to landing interference, the head modules are adjusted in a direction of $\Delta x<0$, and when the alignment of the head modules is opposite to the alignment of the head modules corresponding to the droplets having the largest interval due to landing interference, the head modules are adjusted in a direction of $\Delta x>0$.

12. The method according to claim 2, wherein, when a link positioning precision of the head modules is $\Delta x$, $\Delta x>0$ is a direction of increasing a distance between adjacent head modules, and $\Delta x<0$ is a direction of decreasing the distance between adjacent head modules, when the alignment of the head modules is the same as the alignment of the head modules corresponding to the droplets having the largest interval due to landing interference, the head modules are adjusted in a direction of $\Delta x<0$, and when the alignment of the head modules is opposite to the alignment of the head modules corresponding to the droplets having the largest interval due to landing interference, the head modules are adjusted in a direction of $\Delta x>0$.

13. The method according to claim 3, wherein, when a link positioning precision of the head modules is $\Delta x$, $\Delta x>0$ is a direction of increasing a distance between adjacent head modules, and $\Delta x<0$ is a direction of decreasing the distance between adjacent head modules, when the alignment of the head modules is the same as the alignment of the head modules corresponding to the droplets having the largest interval due to landing interference, the head modules are adjusted in a direction of $\Delta x<0$, and when the alignment of the head modules is opposite to the alignment of the head modules corresponding to the droplets having the largest interval due to landing interference, the head modules are adjusted in a direction of $\Delta x>0$.

14. The method according to claim 4, wherein, when a link positioning precision of the head modules is $\Delta x$, $\Delta x>0$ is a direction of increasing a distance between adjacent head modules, and $\Delta x<0$ is a direction of decreasing the distance between adjacent head modules, when the alignment of the head modules is the same as the alignment of the head modules corresponding to the droplets having the largest interval due to landing interference, the head modules are adjusted in a direction of $\Delta x<0$, and when the alignment of the head modules is opposite to the alignment of the head modules corresponding to the droplets having the largest interval due to landing interference, the head modules are adjusted in a direction of $\Delta x>0$.

15. The method according to claim 3, wherein head modules corresponding to a plurality of kinds of ink including a black ink are provided, and the head modules corresponding to ink of other colors than the black ink are adjusted with a center value of the image quality allowable range determined using the black ink as a target.

16. The method according to claim 4, wherein head modules corresponding to a plurality of kinds of ink including a black ink are provided, and the head modules corresponding to ink of other colors than the black ink are adjusted with a center value of the image quality allowable range determined using the black ink as a target.

17. The method according to claim 5, wherein head modules corresponding to a plurality of kinds of ink including a black ink are provided, and the head modules corresponding to ink of other colors than the black ink are adjusted with a center value of the image quality allowable range determined using the black ink as a target.

18. The method according to claim 6, wherein head modules corresponding to a plurality of kinds of ink including a black ink are provided, and the head modules corresponding to ink of other colors than the black ink are adjusted with a center value of the image quality allowable range determined using the black ink as a target.

19. A method for manufacturing an inkjet head, comprising adjusting a head module using the method according to claim 1.

20. An inkjet head which is adjusted by the method for adjusting a head module according to claim 1.

* * * * *